US009556762B2

(12) United States Patent
Sugiura et al.

(10) Patent No.: US 9,556,762 B2
(45) Date of Patent: Jan. 31, 2017

(54) VARIABLE VALVE MECHANISM OF INTERNAL COMBUSTION ENGINE

(71) Applicant: Otics Corporation, Nishio-shi (JP)

(72) Inventors: Masatoshi Sugiura, Nishio (JP); Naoki Hiramatsu, Nishio (KR); Koki Yamaguchi, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 0 days.

(21) Appl. No.: 14/663,346

(22) Filed: Mar. 19, 2015

(65) Prior Publication Data

US 2015/0285110 A1 Oct. 8, 2015

(30) Foreign Application Priority Data

Apr. 8, 2014 (JP) ..... 2014-079485

(51) Int. Cl.
*F01L 1/18* (2006.01)
*F01L 13/00* (2006.01)

(52) U.S. Cl.
CPC ..... *F01L 13/0021* (2013.01); *F01L 1/185* (2013.01); *F01L 13/0036* (2013.01); *F01L 2001/186* (2013.01)

(58) Field of Classification Search
CPC .... F01L 1/185; F01L 13/0021; F01L 13/0036; F01L 2001/186
USPC ..... 123/90.16, 90.39, 90.44
See application file for complete search history.

(56) References Cited

U.S. PATENT DOCUMENTS

| | | | | |
|---|---|---|---|---|
| 5,101,778 | A | 4/1992 | Fukuo et al. | |
| 5,651,336 | A | 7/1997 | Rygiel et al. | |
| 6,186,102 | B1 | 2/2001 | Kosuge et al. | |
| 6,412,460 | B1 * | 7/2002 | Sato | F01L 1/053 123/90.16 |
| 7,174,869 | B2 * | 2/2007 | Proschko | F01L 1/185 123/90.39 |
| 2003/0200947 | A1 | 10/2003 | Harris | |
| 2004/0074459 | A1 | 4/2004 | Hayman et al. | |

(Continued)

FOREIGN PATENT DOCUMENTS

| | | | |
|---|---|---|---|
| DE | 199 61 759 | A1 | 6/2000 |
| DE | 10 2004 027 054 | A1 | 12/2005 |

(Continued)

OTHER PUBLICATIONS

Extended European Search Report dated Jan. 20, 2016.

*Primary Examiner* — Ching Chang
(74) *Attorney, Agent, or Firm* — McGinn IP Law Group, PLLC.

(57) ABSTRACT

The present invention provides a variable valve mechanism of an internal combustion engine, which includes a rocker arm that is swingably supported by a single pivot, and a switching device that operates the rocker arm to switch a drive state of the valve, in which the rocker arm is configured such that at least in a predetermined drive state, a pressing force of the cam is applied disproportionately to one side of the rocker arm in a width direction with respect to a center line when the cam presses a portion of the rocker arm located away from the center line in the width direction. The variable valve mechanism further includes a swing guide that abuts against the rocker arm so that the rocker arm is guided in a swing direction so as not to be tilted in the width direction.

19 Claims, 9 Drawing Sheets

(56) References Cited

U.S. PATENT DOCUMENTS

| | | | |
|---|---|---|---|
| 2005/0247279 | A1 | 11/2005 | Rorig et al. |
| 2006/0157011 | A1 | 7/2006 | Proschko et al. |
| 2011/0132302 | A1 | 6/2011 | Hayashi et al. |

FOREIGN PATENT DOCUMENTS

| | | | |
|---|---|---|---|
| EP | 1 013 898 | A2 | 6/2000 |
| EP | 1 013 898 | A3 | 10/2000 |

* cited by examiner

REFERENCE
EXAMPLE

VARIABLE VALVE MECHANISM OF INTERNAL COMBUSTION ENGINE

TECHNICAL FIELD

The present invention relates to a variable valve mechanism that drives a valve of an internal combustion engine and that changes the drive state of the valve in accordance with the operating status of the internal combustion engine.

BACKGROUND ART

Variable valve mechanisms are described in Patent Documents 1 to 5. As with a variable valve mechanism 100 according to the related art (Patent Document 5) illustrated in FIG. 8, for example, all of the variable valve mechanisms include a rocker arm 101 that is swingably supported by a single pivot 105 and that swings when pressed by cams 108 and 109 to drive a valve 6, and a switching device 106 that operates the rocker arm 101 to switch the drive state of the valve 6.

Specifically, the rocker arm 101 includes an inner arm 103 and an outer arm 104 provided around the inner arm 103. The inner arm 103 is pressed by an inner cam 108. The outer arm 104 is pressed by two outer cams 109 and 109 having the same profile and provided on both sides of the inner cam 108 in the width direction. The switching device 106 relatively indisplaceably couples and decouples the outer arm 104 to and from the inner arm 103 to switch the drive state of the valve 6.

CITATION LIST

Patent Documents

Patent Document 1: U.S. Patent Application Publication No. 2005/0247279 (US 2005/0247279)

Patent Document 2: German Patent Application Publication No. 10 2004 027 054 (DE 10 2004 027 054)

Patent Document 3: U.S. Patent Application Publication No. 2006/0157011 (US 2006/0157011)

Patent Document 4: U.S. Patent Application Publication No. 2003/0200947 (US 2003/0200947)

Patent Document 5: U.S. Patent Application Publication No. 2004/0074459 (US 2004/0074459)

SUMMARY OF THE INVENTION

Technical Problem

According to the variable valve mechanism 100 described above, the balance of the rocker arm 101 in the width direction can be kept by pressing the outer arm 104 with the two outer cams 109 and 109 having the same profile and provided on both sides of the inner cam 108 in the width direction. Therefore, even the rocker arm 101 supported by the single pivot 105 is not easily tilted in the width direction.

Although the variable valve mechanism 100 described above supports two-stage switching, the variable valve mechanism 100 does not support three-stage switching. In addition, it is also difficult to further provide the variable valve mechanism 100 described above with a separate second outer arm around the outer arm 104 in order to achieve three-stage switching. This is because the installation space for the rocker arm is limited and the structure of the rocker arm is complicated.

Meanwhile, in the case where three-stage switching is attempted using a configuration such as a variable valve mechanism 110 according to a reference example illustrated in FIG. 9, for example, a rocker arm 111 is easily tilted in the width direction. That is, the variable valve mechanism 110 according to the reference example includes a rocker arm 111 described below. The rocker arm 111 includes three arms 112, 113, and 114, namely a main arm 113, a first sub arm 112, and a second sub arm 114. The main arm 113 is swingably supported by a single pivot 115 to be pressed by a small lift cam 118. The first sub arm 112 is pressed by a medium lift cam 117 on one side in the width direction with respect to the main arm 113. The second sub arm 114 is pressed by a large lift cam 119 on the other side in the width direction with respect to the main arm 113.

The main arm 113 is driven by the small lift cam 118 by establishing a non-coupled state in which none of the sub arms 112 and 114 is relatively indisplaceably coupled to the main arm 113. The main arm 113 is driven by the medium lift cam 117 via the first sub arm 112 by establishing a first coupled state in which only the first sub arm 112 is coupled to the main arm 113. The main arm 113 is driven by the large lift cam 119 via the second sub arm 114 by establishing a second coupled state in which the second sub arm 114 is coupled to the main arm 113.

Although it seems that three-stage switching can be achieved by operating the variable valve mechanism 110 in the manner described above, the rocker arm 111 is easily tilted in the width direction. This is because the pressing force of the cams 117 and 119 is applied disproportionately to one side in the width direction of the rocker arm 111 supported by the single pivot 115 at least in the first coupled state and the second coupled state.

Specifically, in the first coupled state, the nose of the small lift cam 118 does not reach the main arm 113, and the second sub arm 114 is pressed by the large lift cam 119 but idles. Therefore, at this time, the rocker arm 111 is pressed by the medium lift cam 117 to the greatest degree. Therefore, the pressing force of the cams 117, 118, and 119 is applied disproportionately to one side in the width direction where the medium lift cam 117 is located, which causes the rocker arm 111 to be easily tilted to one side in the width direction.

In the second coupled state, the nose of the small lift cam 118 does not reach the main arm 113, and the nose of the medium lift cam 117 also does not reach the first sub arm 112. Thus, the rocker arm 111 is pressed by only the large lift cam 119. Therefore, the pressing force of the cams 117, 118, and 119 is applied disproportionately to the other side in the width direction where the large lift cam 119 is located, which causes the rocker arm 111 to be easily tilted to the other side in the width direction.

It is therefore a first object to prevent a rocker arm supported by a single pivot from being tilted to one side in the width direction of the rocker arm even if the pressing force of a cam is applied disproportionately to one side in the width direction of the rocker arm. In addition, it is a second object to achieve three-stage switching using the rocker arm.

Solution to Problem

In order to achieve the first object (tilt prevention) described above, the present invention provides a variable valve mechanism of an internal combustion engine, including: a rocker arm that is swingably supported by a single pivot and that swings when pressed by a cam to drive a valve; and a switching device that operates the rocker arm to switch a drive state of the valve, in which: the rocker arm is configured such that at least in a predetermined drive state, a pressing force of the cam is applied disproportionately to one side of the rocker arm in a width direction with respect to a center line when the cam presses a portion of the rocker arm located away from the center line in the width direction, the center line passing through a center of gravity of the rocker arm and extending in a longitudinal direction of the rocker arm; and the variable valve mechanism further includes a swing guide that abuts against the rocker arm so that the rocker arm is guided in a swing direction so as not to be tilted in the width direction.

Although the specific aspect of the variable valve mechanism is not specifically limited, examples of the aspect include the following aspects (A) and (B). It should be noted, however, that the aspect (B) is preferable in order that the second object (three-stage switching) described above is achieved.

(A) An aspect in which: the rocker arm includes two arms including a main arm and a sub arm, the main arm including a drive portion that drives the valve, and the sub arm being driven by a predetermined cam on one side in the width direction with respect to the center line; the switching device performs two-stage switching between a non-coupled state and a coupled state, the non-coupled state being a state in which the sub arm is not relatively indisplaceably coupled to the main arm, and the coupled state being a state in which the main arm is driven by the predetermined cam with the sub arm relatively indisplaceably coupled to the main arm; and a pressing force of the cam is applied disproportionately to one side in the width direction with respect to the center line in the coupled state.

(B) An aspect in which: the rocker arm includes three arms including a main arm, a first sub arm, and a second sub arm, the main arm including a supported portion supported by the pivot and a drive portion that drives the valve, the first sub arm being pressed by a predetermined cam on one side in the width direction with respect to the center line, and the second sub arm being pressed by another cam with a lift amount or an action angle larger than that of the predetermined cam on the other side in the width direction with respect to the center line; the switching device performs three-stage switching among a non-coupled state, a first coupled state, and a second coupled state, the non-coupled state being a state in which none of the first sub arm and the second sub arm is relatively indisplaceably coupled to the main arm, the first coupled state being a state in which the main arm is driven by the predetermined cam with the first sub arm relatively indisplaceably coupled to the main arm and with the second sub arm not relatively indisplaceably coupled to the main arm, and the second coupled state being a state in which the main arm is driven by the another cam with the second sub arm relatively indisplaceably coupled to the main arm; and a pressing force of the cam is applied disproportionately to one side in the width direction with respect to the center line in the first coupled state, and a pressing force of the cam is applied disproportionately to the other side in the width direction with respect to the center line in the second coupled state.

[Rocker Arm]

Although the aspect of the rocker arm is not specifically limited, examples of the aspect include the following aspects (a) and (b).

(a) An aspect in which the rocker arm includes a drive portion that drives the valve and a guided portion that abuts against the swing guide, the drive portion being provided on one side in the longitudinal direction of the rocker arm with respect to a supported portion supported by the pivot, and the guided portion being provided on the other side in the longitudinal direction of the rocker arm with respect to the supported portion.

(b) An aspect in which the rocker arm includes a drive portion that drives the valve and a guided portion that abuts against the swing guide, the drive portion and the guided portion being provided on one side in the longitudinal direction of the rocker arm with respect to a supported portion supported by the pivot.

Although the aspect of the main arm in the non-coupled state is not specifically limited in the aspect (A) (two-stage switching) and the aspect (B) (three-stage switching) described above, examples of the aspect include the following aspects (a) and (b).

(a) An aspect in which the main arm is driven by another cam with a lift amount or an action angle smaller than that of the predetermined cam in the non-coupled state.

(b) An aspect in which the main arm is not driven by any cam in the non-coupled state. At this time, the main arm may abut against a circular cam having a circular cross-sectional shape, or no such circular cam may be provided.

Although the relative displacement of the sub arm with respect to the main arm is not specifically limited in the aspect (A) (two-stage switching) and the aspect (B) (three-stage switching) described above, examples of the relative displacement include relative swing and linear reciprocal motion in the up-down direction.

Although the pivot may be a pivot for manual adjustment of a valve clearance, the pivot is preferably a plunger of a lash adjuster because a valve clearance can be automatically adjusted.

[Switching Device]

Although the aspect of the switching device is not specifically limited in the aspect (B) (three-stage switching) described above, the following aspect is preferable in that three-stage switching can be achieved using a single hydraulic path. In the aspect, the switching device includes two coupling pins including a first coupling pin and a second coupling pin, the first coupling pin being provided so as to be displaceable between a position at which the first coupling pin extends across an interface between the main arm and the first sub arm and a position at which the first coupling pin does not, and the second coupling pin being provided so as to be displaceable between a position at which the second coupling pin extends across an interface between the main arm and the second sub arm and a position at which the second coupling pin does not, two springs with different urging forces including a first spring and a second spring, the first spring being configured to urge the first coupling pin toward the main arm, and the second spring being configured to urge the second coupling pin toward the main arm, and a hydraulic device including a hydraulic chamber provided inside the main arm and configured to press the first coupling pin toward the first sub arm and press the second coupling pin toward the second sub arm using a hydraulic pressure in the hydraulic chamber; and one of the three states is established by bringing the hydraulic pressure in the hydraulic chamber to a low pressure that is less than an urging force of the first spring or the second spring, whichever is weaker, another one of the three states is established by bringing the hydraulic pressure in the hydraulic chamber to a medium pressure that is more than the urging force of the first spring or the second spring, whichever is weaker and that is less than an urging force of the first spring or the second spring, whichever is stronger, and the remaining one of the three states is established by bringing the hydraulic pressure in the hydraulic chamber to a high pressure that is more than the urging force of the first spring or the second spring, whichever is stronger.

More specific examples include the following aspects (1) to (4).

(1) An aspect (first embodiment) in which the first spring is the weaker spring, the second spring is the stronger spring, a first non-coupling position and a second non-coupling position are on the main arm side, a first coupling position is on the first sub arm side, a second coupling position is on the second sub arm side, the non-coupled state is established by bringing the hydraulic pressure in the hydraulic chamber to a low pressure, the first coupled state is established by bringing the hydraulic pressure in the hydraulic chamber to a medium pressure, and the second coupled state is established by bringing the hydraulic pressure in the hydraulic chamber to a high pressure.

(2) An aspect in which the first spring is the stronger spring, the second spring is the weaker spring, a first coupling position and a second coupling position are on the main arm side, a first non-coupling position is on the first sub arm side, a second non-coupling position is on the second sub arm side, the second coupled state is established by bringing the hydraulic pressure in the hydraulic chamber to a low pressure, the first coupled state is established by bringing the hydraulic pressure in the hydraulic chamber to a medium pressure, and the non-coupled state is established by bringing the hydraulic pressure in the hydraulic chamber to a high pressure.

(3) An aspect in which the first spring is the weaker spring, the second spring is the stronger spring, a first coupling position and a second non-coupling position are on the main arm side, a first non-coupling position is on the first sub arm side, a second coupling position is on the second sub arm side, the first coupled state is established by bringing the hydraulic pressure in the hydraulic chamber to a low pressure, the non-coupled state is established by bringing the hydraulic pressure in the hydraulic chamber to a medium pressure, and the second coupled state is established by bringing the hydraulic pressure in the hydraulic chamber to a high pressure.

(4) An aspect (third embodiment) in which the first spring is the stronger spring, the second spring is the weaker spring, a first non-coupling position and a second coupling position are on the main arm side, a first coupling position is on the first sub arm side, a second non-coupling position is on the second sub arm side, the second coupled state is established by bringing the hydraulic pressure in the hydraulic chamber to a low pressure, the non-coupled state is established by bringing the hydraulic pressure in the hydraulic chamber to a medium pressure, and the first coupled state is established by bringing the hydraulic pressure in the hydraulic chamber to a high pressure.

In the aspect (B) (three-stage switching) described above, the switching device may or may not relatively indisplaceably couple the first sub arm to the main arm in the second coupled state. It should be noted, however, that a configuration in which the first sub arm is relatively indisplaceably coupled to the main arm is structurally and functionally simpler. In the case where a lift curve of the predetermined cam and a lift curve of another cam cross each other, the first sub arm cannot be relatively indisplaceably coupled to the main arm in the second coupled state. Specific examples of the aspect in which the first sub arm is relatively indisplaceably coupled to the main arm in the second coupled state include the aspects (1) and (2) described above. Specific examples of the aspect in which the first sub arm is not relatively indisplaceably coupled to the main arm in the second coupled state include the aspects (3) and (4) described above.

[Swing Guide]

Although the aspect of the swing guide is not specifically limited, examples of the aspect include the following aspects (a) and (b). It should be noted, however, that the aspect (a) is preferable in that the shape of the swing guide is simpler.

(a) An aspect in which the rocker arm includes a recessed portion provided at an end portion in the longitudinal direction of the rocker arm to be recessed inward in the longitudinal direction; and the swing guide is in sliding contact with an inner surface of the recessed portion from both sides in the width direction of the rocker arm to abut against the rocker arm.

(b) An aspect in which the swing guide has a U cross-sectional shape; and the swing guide abuts against the rocker arm with the U-shaped inner peripheral surface of the swing guide in sliding contact with the rocker arm from both sides in the width direction of the rocker arm.

Although the direction in which the swing guide extends is not specifically limited, examples of the direction include the following aspects (a) and (b).

(a) An aspect in which the swing guide extends linearly in a tangential direction to the swing direction of the rocker arm.

(b) An aspect in which the swing guide extends along a curve in the swing direction of the rocker arm.

The guided portion of the rocker arm which abuts against the swing guide is not specifically limited. In order to reduce friction, however, a rotatably supported roller may be used.

Advantageous Effects of Invention

The variable valve mechanism according to the present invention includes the swing guide which abuts against the rocker arm supported by the single pivot so that the rocker arm is guided in the swing direction so as not to be tilted in the width direction. Thus, the rocker arm will not be tilted to one side in the width direction even in the predetermined drive state in which the pressing force of the cam is applied disproportionately to one side of the rocker arm in the width direction with respect to the center line.

DESCRIPTION OF EMBODIMENTS

Figure 1:
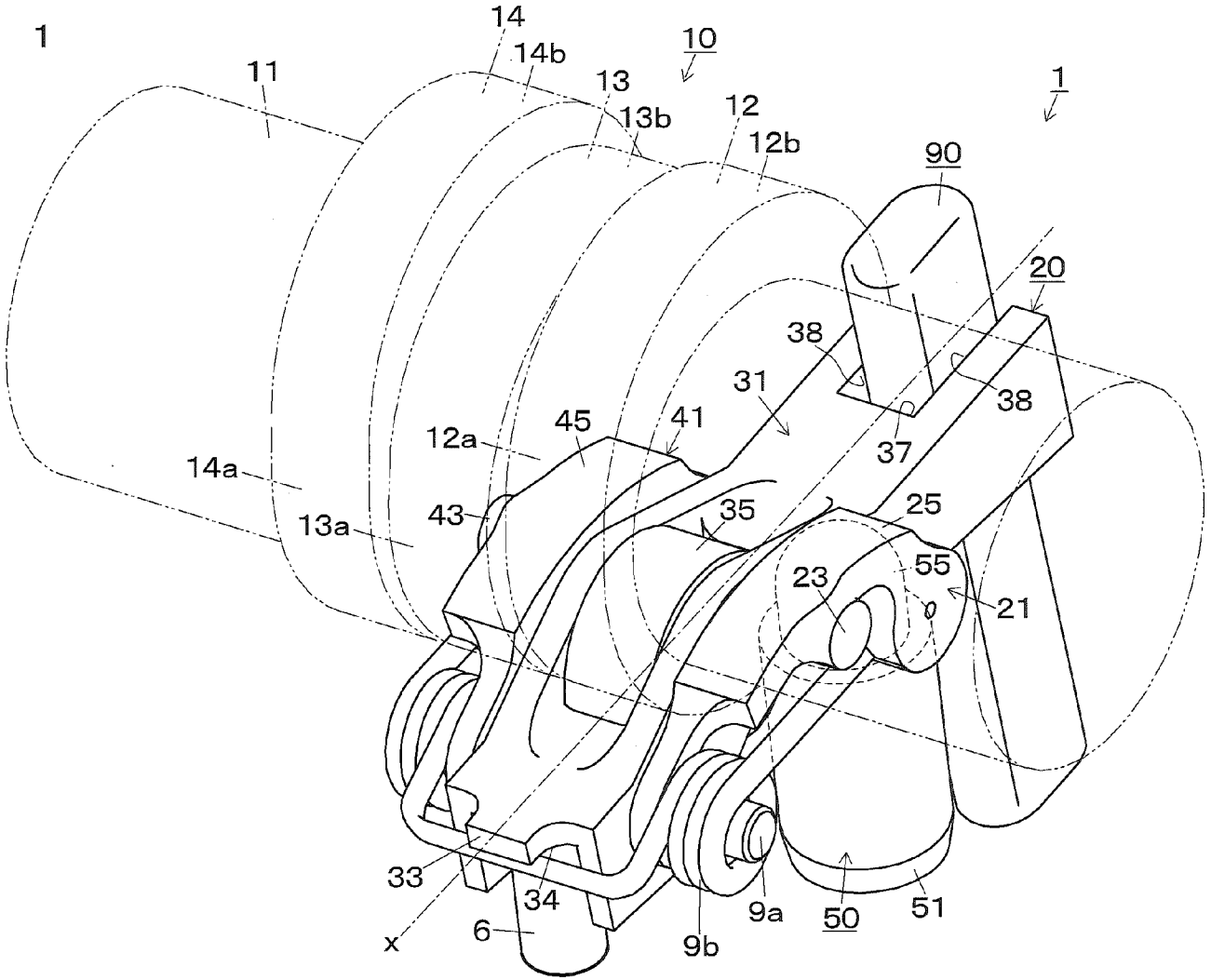
FIG. 1 is a perspective view illustrating a variable valve mechanism according to a first embodiment.
Figure 2B:
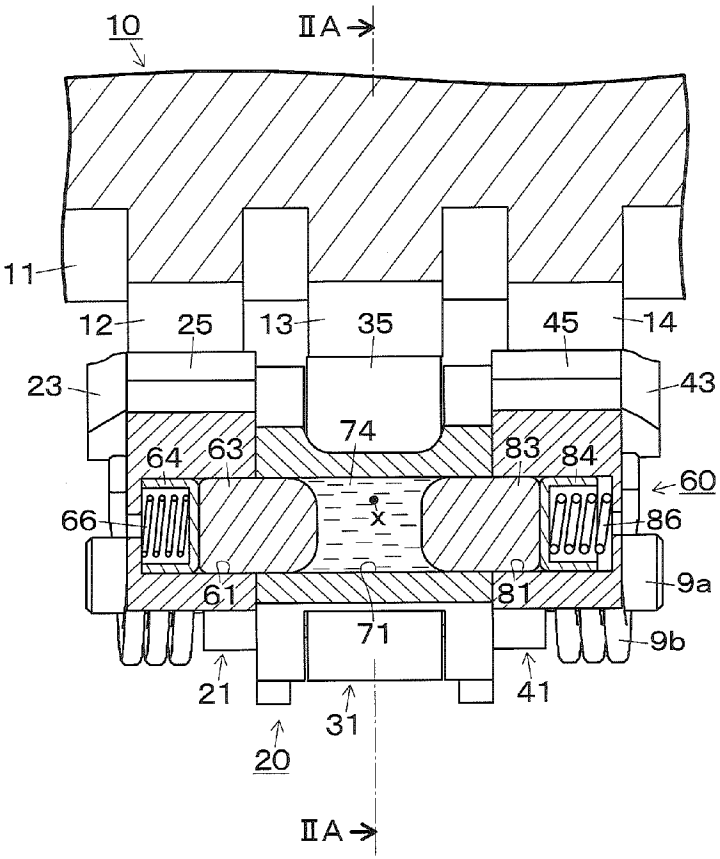
FIGS. 2A and 2B are a side sectional view and a back sectional view, respectively, illustrating the variable valve mechanism according to the first embodiment.
Figure 2A:
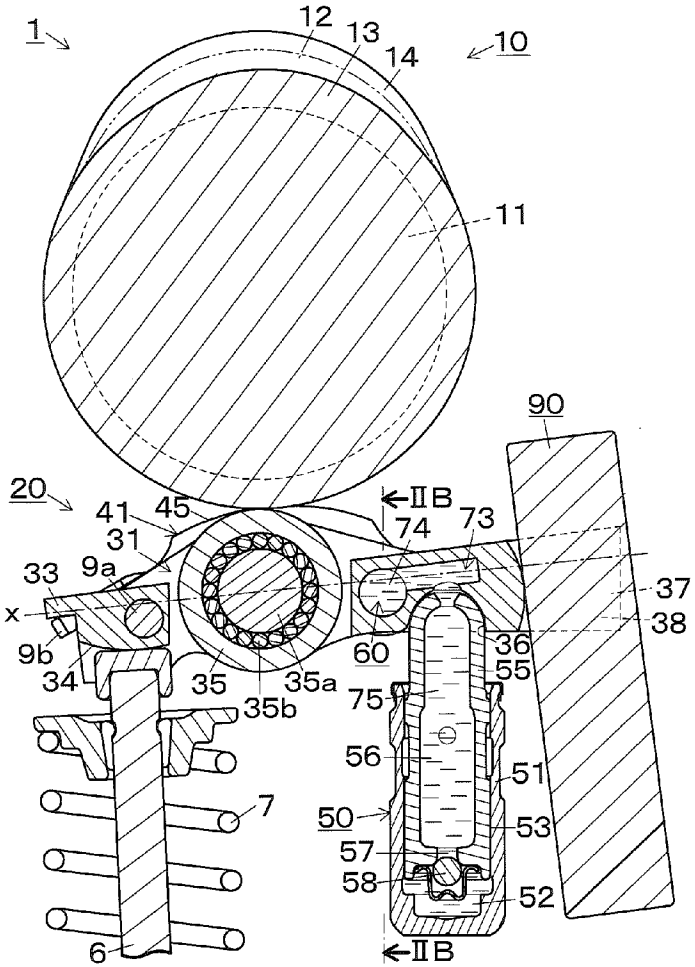

A variable valve mechanism according to the present invention will be described below with reference to the drawings. In the following description, one side (the left side in the back views) in the width direction of a rocker arm 20 is referred to as the "left side", and the other side (the right side in the back views) is referred to as the "right side". In addition, one side in the longitudinal direction of the rocker arm 20 is referred to as the "front side", and the other side is referred to as the "rear side".

First Embodiment

Overall Configuration

A variable valve mechanism 1 according to a first embodiment illustrated in FIGS. 1 to 5B includes a rocker arm 20 that is swingably supported by only a single pivot 55 at one point and that swings when pressed by cams 12, 13, and 14 to drive a valve 6, and a switching device 60 that operates the rocker arm 20 to switch the drive state of the valve 6.

Figure 4B:
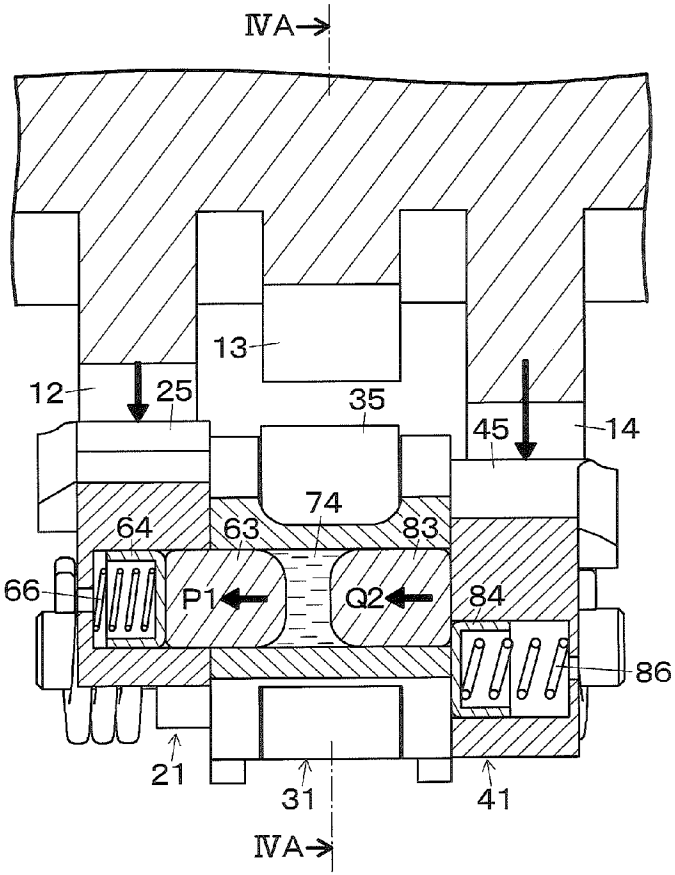
FIGS. 4A and 4B are a side sectional view and a back sectional view, respectively, illustrating the variable valve mechanism according to the first embodiment in a first coupled state.
Figure 4A:
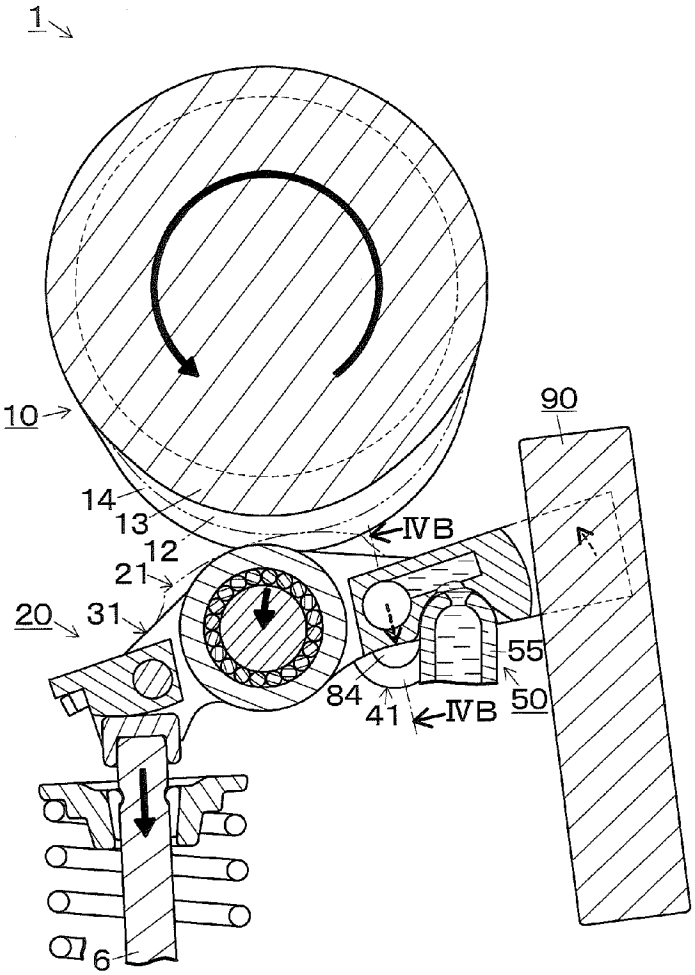

The rocker arm 20 is configured such that in a first coupled state illustrated in FIGS. 4A and 4B, the pressing force of the cams 12, 13, and 14 is applied disproportionately to the left side with respect to a center line x passing through the center of gravity of the rocker arm 20 and extending in the front-rear direction with a medium lift cam 12 pressing a first slipper 25 located on the left side away from the center line x. In addition, the rocker arm 20 is configured such that in a second coupled state illustrated in FIGS. 5A and 5B, the pressing force of the cams 12, 13, and 14 is applied disproportionately to the right side with respect to the center line x with a large lift cam 14 pressing a second slipper 45 located on the right side away from the center line x. To this end, the variable valve mechanism 1 according to the first embodiment includes a swing guide 90 that abuts against the rocker arm 20 so that the rocker arm 20 is guided in the swing direction so as not to be tilted in the left-right direction.

Specifically, the variable valve mechanism 1 includes a rotary drive portion 10, the rocker arm 20, a lash adjuster 50, the switching device 60, and the swing guide 90 described below. A valve spring 7 is attached to the valve 6 to urge the valve 6 in the closing direction.

[Rotary Drive Portion 10]

The rotary drive portion 10 includes three cams 12, 13, and 14 provided on a camshaft 11 extending in the left-right direction to rotate together with the camshaft 11. The three cams 12, 13, and 14 include a small lift cam 13, the medium lift cam 12 provided on the left side of the small lift cam 13, and the large lift cam 14 provided on the right side of the small lift cam 13.

Specifically, the small lift cam 13 includes a base circle 13*a* having a circular cross-sectional shape, and a small lift nose 13*b* that projects from the base circle 13*a*. The medium lift cam 12 includes abase circle 12*a* having a circular cross-sectional shape, and a medium lift nose 12*b* that projects from the base circle 12*a* and that has a lift amount and an action angle that are larger than those of the small lift nose 13*b*. The large lift cam 14 includes abase circle 14*a* having a circular cross-sectional shape, and a large lift nose 14*b* that projects from the base circle 14*a* and that has a lift amount and an action angle that are larger than those of the medium lift nose 12*b*.

[Rocker Arm 20]

The rocker arm 20 includes three arms 21, 31, and 41, namely a main arm 31, a first sub arm 21, and a second sub arm 41. The main arm 31 includes a supported portion 36 supported by the pivot 55 and a drive portion 34 that drives the valve 6, and is driven by the small lift cam 13. The first sub arm 21 is pressed by the medium lift cam 12 with a lift amount and an action angle larger than those of the small lift cam 13 on the left side with respect to the center line x. The second sub arm 41 is driven by the large lift cam 14 with a lift amount and an action angle larger than those of the medium lift cam 12 on the right side with respect to the center line x.

Specifically, the main arm 31 includes a projection 33 provided at the front end portion to abut against a lost motion spring 9*b* to be discussed later from above, and the drive portion 34 provided on the lower surface of the front end portion to drive the valve 6. A roller 35 is rotatably supported via a support shaft 35*a* and bearings 35*b* in rear of the drive portion 34. The roller 35 abuts against the small lift cam 13 from below. The supported portion 36 recessed upward in a hemispherical shape is provided in a lower surface on the rear side with respect to the roller 35. The supported portion 36 is swingably supported by the upper end portion of a plunger 55 of the lash adjuster 50. A recessed portion 37 recessed forward is provided at a rear end portion in rear of the supported portion 36. A left side inner surface of the recessed portion 37 constitutes a left guided portion 38 in sliding contact with the left side surface of the swing guide 90. Aright side inner surface of the recessed portion 37 constitutes a right guided portion 38 in sliding contact with the right side surface of the swing guide 90.

The respective front end portions of the first sub arm 21 and the second sub arm 41 are relatively displaceably (relatively swingably) coupled to the front end portion of the main arm 31 via a coupling shaft 9*a*. The first slipper 25 in sliding contact with the medium lift cam 12 is provided on the upper surface of the middle portion of the first sub arm 21 in the front-rear direction. The second slipper 45 in sliding contact with the large lift cam 14 is provided on the upper surface of the middle portion of the second sub arm 41 in the front-rear direction. In addition, projections 23 and 43 urged from below by the lost motion spring 9*b* to be discussed later are provided at the middle portion of the first sub arm 21 in the front-rear direction and the middle portion of the second sub arm 41 in the front-rear direction, respectively.

The lost motion spring 9*b* is interposed between the projection 23 of the first sub arm 21 and the projection 43 of the second sub arm 41 so as to extend by way of the projection 33 of the main arm 31. The lost motion spring 9*b* is a torsion coil spring having coiled portions at two locations in the longitudinal direction. The coiled portions are externally fitted on both the left and right end portions of the coupling shaft 9*a* projecting leftward and rightward from the rocker arm 20. The left side portion of the lost motion spring 9*b* urges the first sub arm 21 toward the medium lift cam 12 when the first sub arm 21 is not relatively indisplaceably coupled to the main arm 31 (that is, in the first embodiment, in the non-coupled state), and presses the first sub arm 21 against the main arm 31 via a first coupling pin 63 to be discussed later when the first sub arm 21 is relatively indisplaceably coupled to the main arm 31 (that is, in the first embodiment, in the first coupled state and the second coupled state). In addition, the right side portion of the lost motion spring 9*b* urges the second sub arm 41 toward the large lift cam 14 when the second sub arm 41 is not relatively indisplaceably coupled to the main arm 31 (that is, in the first embodiment, in the non-coupled state and the first coupled state), and presses the second sub arm 41 against the main arm 31 via a second coupling pin 83 to be discussed later when the second sub arm 41 is relatively indisplaceably coupled to the main arm 31 (that is, in the first embodiment, in the second coupled state).

[Lash Adjuster 50]

The lash adjuster 50 includes a bottomed cylindrical body 51 that opens upward, and a plunger 55, the lower portion of which is inserted into the body 51. The upper end portion of the plunger 55 has a hemispherical shape. The upper end of the plunger 55 swingably supports the supported portion 36 of the main arm 31. When a valve clearance is formed, the plunger 55 advances out of the body 51 to fill the valve clearance. When a downward load is applied from the main arm 31 to the plunger 55, the plunger 55 retracts into the body 51.

Specifically, when the plunger 55 retracts, oil within a high-pressure hydraulic chamber 52 provided inside the body 51 leaks into a low-pressure hydraulic chamber 56 provided inside the plunger 55 through a leak path 53 to cause a flow resistance. Therefore, the plunger 55 gradually slowly retracts into the body 51. When the plunger 55 advances, the plunger 55 advances out of the body 51 by the restoring force of a spring (not illustrated) provided inside the body 51. At this time, oil in the low-pressure hydraulic chamber 56 flows into the high-pressure hydraulic chamber 52 through a flow path 57 that is wider than the leak path 53 and that is provided with a check valve 58. Therefore, the flow resistance is not as large as that during retraction of the plunger 55, which allows the plunger 55 to quickly advance out of the body 51.

[Switching Device 60]

The switching device 60 switches the drive state of the valve 6 among three stages, namely the non-coupled state, the first coupled state, and the second coupled state described below.

Figure 3B:
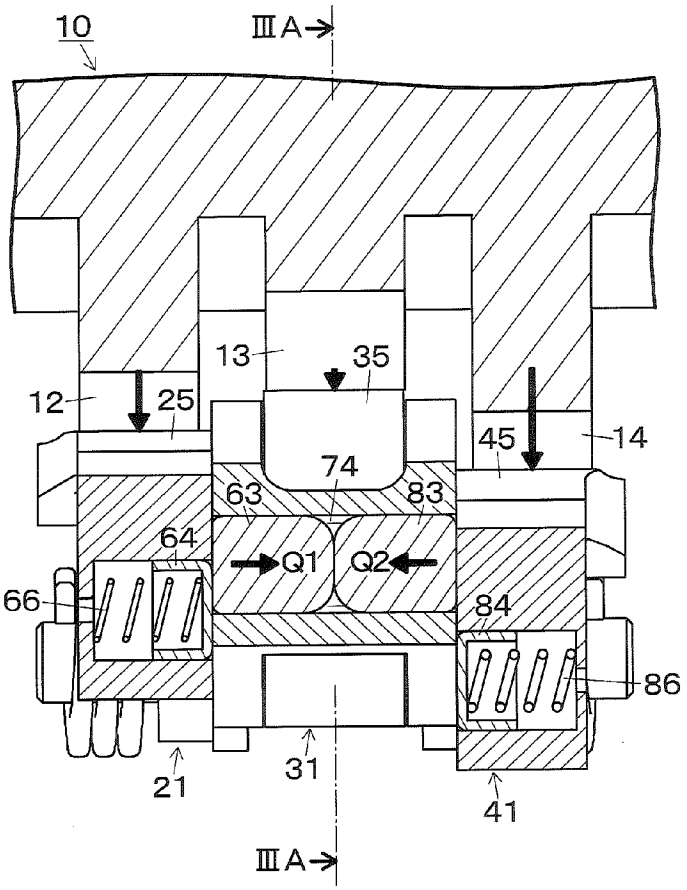
FIGS. 3A and 3B are a side sectional view and a back sectional view, respectively, illustrating the variable valve mechanism according to the first embodiment in a non-coupled state.
Figure 3A:
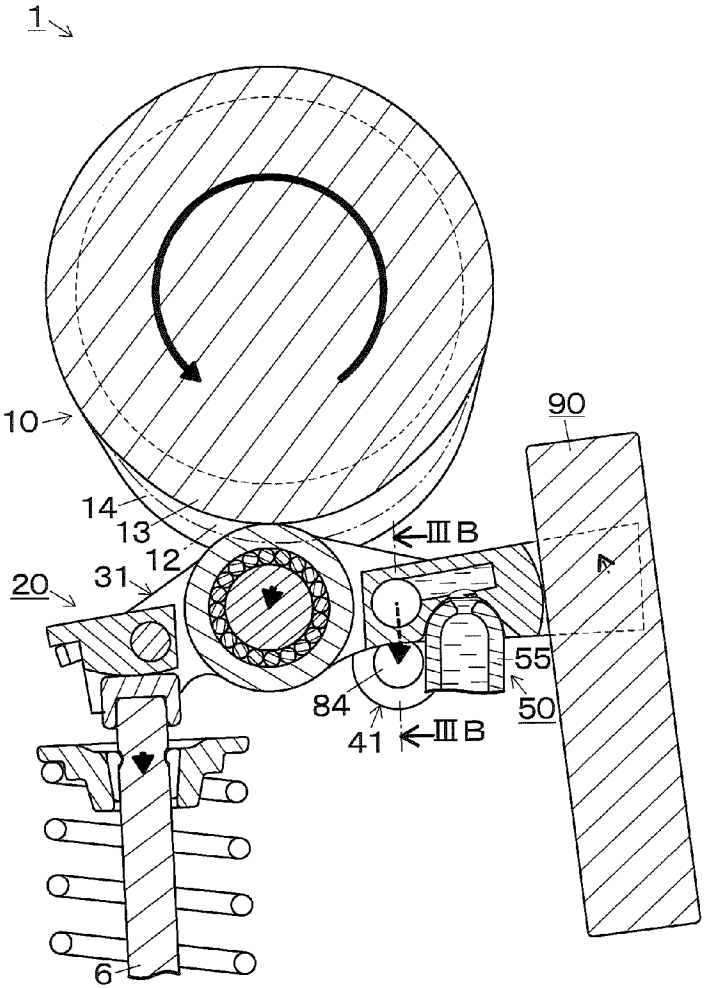

That is, in the non-coupled state, as illustrated in FIGS. 3A and 3B, the main arm 31 is driven by the small lift cam 13 with none of the first sub arm 21 and the second sub arm 41 relatively indisplaceably coupled to the main arm 31. At this time, the first sub arm 21 is pressed by the medium lift cam 12 and idles, and the second sub arm 41 is pressed by the large lift cam 14 and also idles. Therefore, the rocker arm 20 receives a slight pressing force applied from the medium lift cam 12 and the large lift cam 14, and the rocker arm 20 is pressed by the small lift cam 13 to the greatest degree. The small lift cam 13 presses the rocker arm 20 generally uniformly on the left and right sides with respect to the center line x. Therefore, the pressing force of the cams 12, 13, and 14 is not applied to the rocker arm 20 disproportionately in the left-right direction across the center line x. Considering the resistance of the lost motion spring 9*b*, however, the pressing force is applied slightly disproportionately on the large lift cam 14 side (the right side with respect to the center line x) which idles to a greater degree.

In the first coupled state, as illustrated in FIGS. 4A and 4B, the main arm 31 is driven by the medium lift cam 12 via the first sub arm 21 with the first sub arm 21 relatively indisplaceably coupled to the main arm 31 and with the second sub arm 41 not relatively indisplaceably coupled to the main arm 31. At this time, the nose 13*b* of the small lift cam 13 does not reach the main arm 31, and the second sub arm 41 is pressed by the large lift cam 14 and idles. Accordingly, the rocker arm 20 does not receive a pressing force applied from the small lift cam 13, and receives a slight pressing force applied from the large lift cam 14. Therefore, the rocker arm 20 is pressed by the medium lift cam 12 to the greatest degree. The pressing force of the cams 12, 13, and 14 is thus applied to the rocker arm 20 disproportionately on the left side with respect to the center line x where the medium lift cam 12 is located.

Figure 5B:
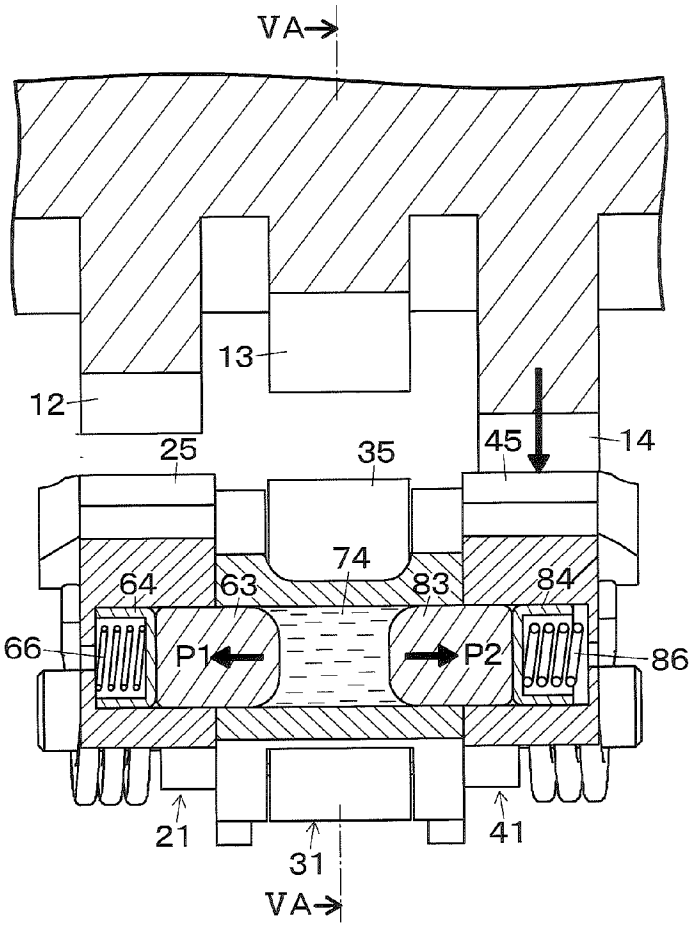
FIGS. 5A and 5B are a side sectional view and a back sectional view, respectively, illustrating the variable valve mechanism according to the first embodiment in a second coupled state.
Figure 5A:
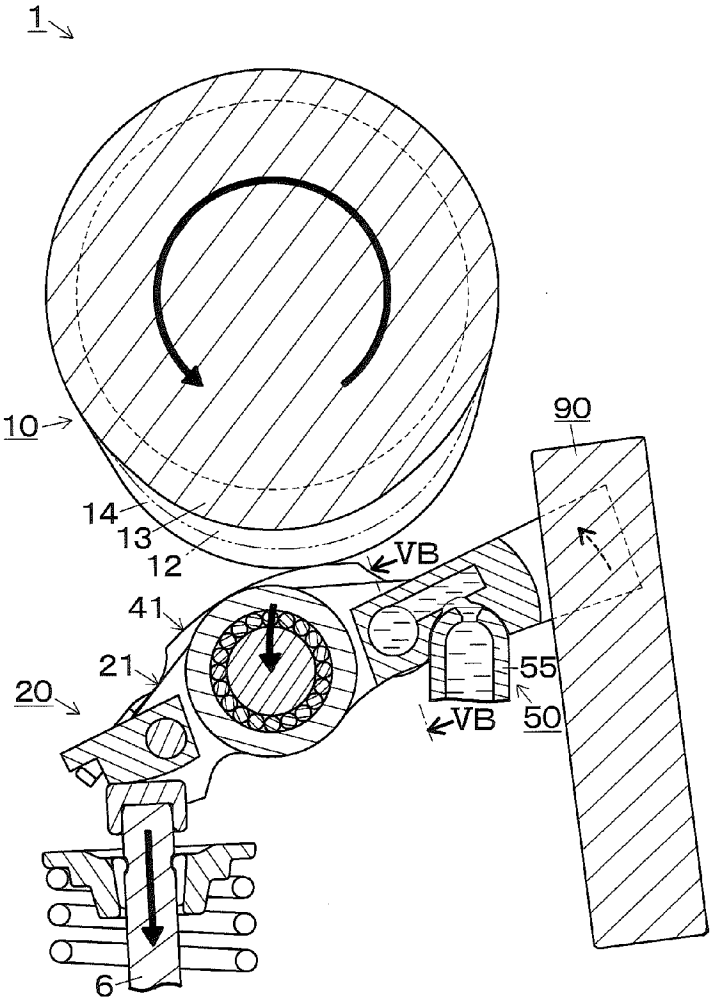

In the second coupled state, as illustrated in FIGS. 5A and 5B, the main arm 31 is driven by the large lift cam 14 via the second sub arm 41 with the first sub arm 21 relatively indisplaceably coupled to the main arm 31 and with the second sub arm 41 also relatively indisplaceably coupled to the main arm 31. At this time, the nose 13*b* of the small lift cam 13 does not reach the main arm 31, and the nose 12*b* of the medium lift cam 12 does not reach the first sub arm 21. Accordingly, the rocker arm 20 does not receive a pressing force applied from the small lift cam 13 or a pressing force applied from the medium lift cam 12. Therefore, the rocker arm 20 is pressed by only the large lift cam 14. The pressing force of the cams 12, 13, and 14 is thus applied to the rocker arm 20 disproportionately on the right side with respect to the center line x where the large lift cam 14 is located.

The switching device 60 specifically includes two coupling pins 63 and 83 described below, two springs 66 and 86, and a hydraulic device 73.

The two coupling pins 63 and 83 include a first coupling pin 63 and a second coupling pin 83. The first coupling pin 63 is provided so as to be displaceable between a first coupling position P1 at which the first coupling pin 63 extends across the interface between the main arm 31 and the first sub arm 21 and a first non-coupling position Q1 at which the first coupling pin 63 does not. The second coupling pin 83 is provided so as to be displaceable between a second coupling position P2 at which the second coupling pin 83 extends across the interface between the main arm 31 and the second sub arm 41 and a second non-coupling position Q2 at which the second coupling pin 83 does not.

Specifically, a center coupling hole 71 that penetrates in the left-right direction is provided in a portion of the main arm 31 in rear of the roller 35 and in front of the supported portion 36. A bottomed first coupling hole 61 that communicates with the center coupling hole 71 is formed in a side surface of the rear end portion of the first sub arm 21 on the main arm 31 side. A bottomed second coupling hole 81 that communicates with the center coupling hole 71 is formed in a side surface of the rear end portion of the second sub arm 41 on the main arm 31 side. The first coupling pin 63 is disposed inside the left portion of the center coupling hole 71, and displaceable between the first non-coupling position Q1 at which the first coupling pin 63 is housed in the center coupling hole 71 and the first coupling position P1 at which the first coupling pin 63 extends across the interface between the center coupling hole 71 and the first coupling hole 61. The second coupling pin 83 is disposed inside the right portion of the center coupling hole 71, and displaceable between the second non-coupling position Q2 at which the second coupling pin 83 is housed in the center coupling hole 71 and the second coupling position P2 at which the second coupling pin 83 extends across the interface between the center coupling hole 71 and the second coupling hole 81.

The two springs 66 and 86 include a first spring 66 and a second spring 86. The first spring 66 urges the first coupling pin 63 toward the first non-coupling position Q1 on the main arm 31 side. The second spring 86 urges the second coupling pin 83 toward the second non-coupling position Q2 on the main arm 31 side. The spring constant of the second spring 86 is larger than the spring constant of the first spring 66, which makes the urging force of the second spring 86 stronger than the urging force of the first spring 66.

Specifically, the first spring 66 is interposed between the inner bottom surface of the first coupling hole 61 and the first coupling pin 63, and urges the first coupling pin 63 toward the main arm 31 via a first intervening pin 64. The second spring 86 is interposed between the inner bottom surface of the second coupling hole 81 and the second coupling pin 83, and urges the second coupling pin 83 toward the main arm 31 via a second intervening pin 84.

The hydraulic device 73 includes a hydraulic chamber 74 and a hydraulic path 75. The hydraulic chamber 74 is formed by blocking the center coupling hole 71 using the first coupling pin 63 and the second coupling pin 83. Oil and a hydraulic pressure are supplied to the hydraulic chamber 74 through the hydraulic path 75. The hydraulic path 75 extends from the inside of a cylinder head to communicate with the hydraulic chamber 74 by way of the inside of the lash adjuster 50 and the inside of the main arm 31.

The hydraulic pressure in the hydraulic chamber 74 is used to press the first coupling pin 63 toward the first coupling position P1 on the first sub arm 21 side, and to press the second coupling pin 83 toward the second coupling position P2 on the second sub arm 41 side. Specifically, the non-coupled state is established by bringing the hydraulic pressure in the hydraulic chamber 74 to a low pressure that is less than the urging force of the first spring 66 as illustrated in FIGS. 3A and 3B, the first coupled state is established by bringing the hydraulic pressure in the hydraulic chamber 74 to a medium pressure that is more than the urging force of the first spring 66 and that is less than the urging force of the second spring 86 as illustrated in FIGS. 4A and 4B, and the second coupled state is established by bringing the hydraulic pressure in the hydraulic chamber 74 to a high pressure that is more than the urging force of the second spring 86 as illustrated in FIGS. 5A and 5B.

[Swing Guide 90]

The swing guide 90 is a member that extends linearly in a tangential direction (up-down direction) to the swing direction of the main arm 31, and is provided to extend into the recessed portion 37 of the main arm 31. The guided portions 38 provided on both the left and right side inner surfaces of the recessed portion 37 of the main arm 31 are in sliding contact with both the left and right side surfaces of the swing guide 90 from both the left and right sides.

With the variable valve mechanism 1 according to the first embodiment, the following effects [A] to [C] can be obtained.

[A] The variable valve mechanism 1 includes the swing guide 90 which abuts against the rocker arm 20 supported by the single pivot 55 so that the rocker arm 20 is guided in the swing direction so as not to be tilted in the left-right direction. Thus, the rocker arm 20 will not be tilted leftward even in the first coupled state in which the pressing force of the cams 12, 13, and 14 is applied to the rocker arm 20 disproportionately on the left side with respect to the center line x. In addition, the rocker arm 20 will not be tilted rightward even in the second coupled state in which the pressing force of the cams 12, 13, and 14 is applied to the rocker arm 20 disproportionately on the right side with respect to the center line x.

[B] The rocker arm 20 is composed of the three arms 21, 31, and 41, and the rocker arm 20 is operated by the switching device 60 as described above. Thus, three-stage switching can be achieved.

[C] The switching device 60 changes the drive state of the valve 6 among three stages by switching the hydraulic pressure in the hydraulic chamber 74 among three stages, namely a low pressure, a medium pressure, and a high pressure. Thus, three-stage switching can be achieved with only the single hydraulic chamber 74 and the hydraulic path 75.

Second Embodiment

Figure 6:
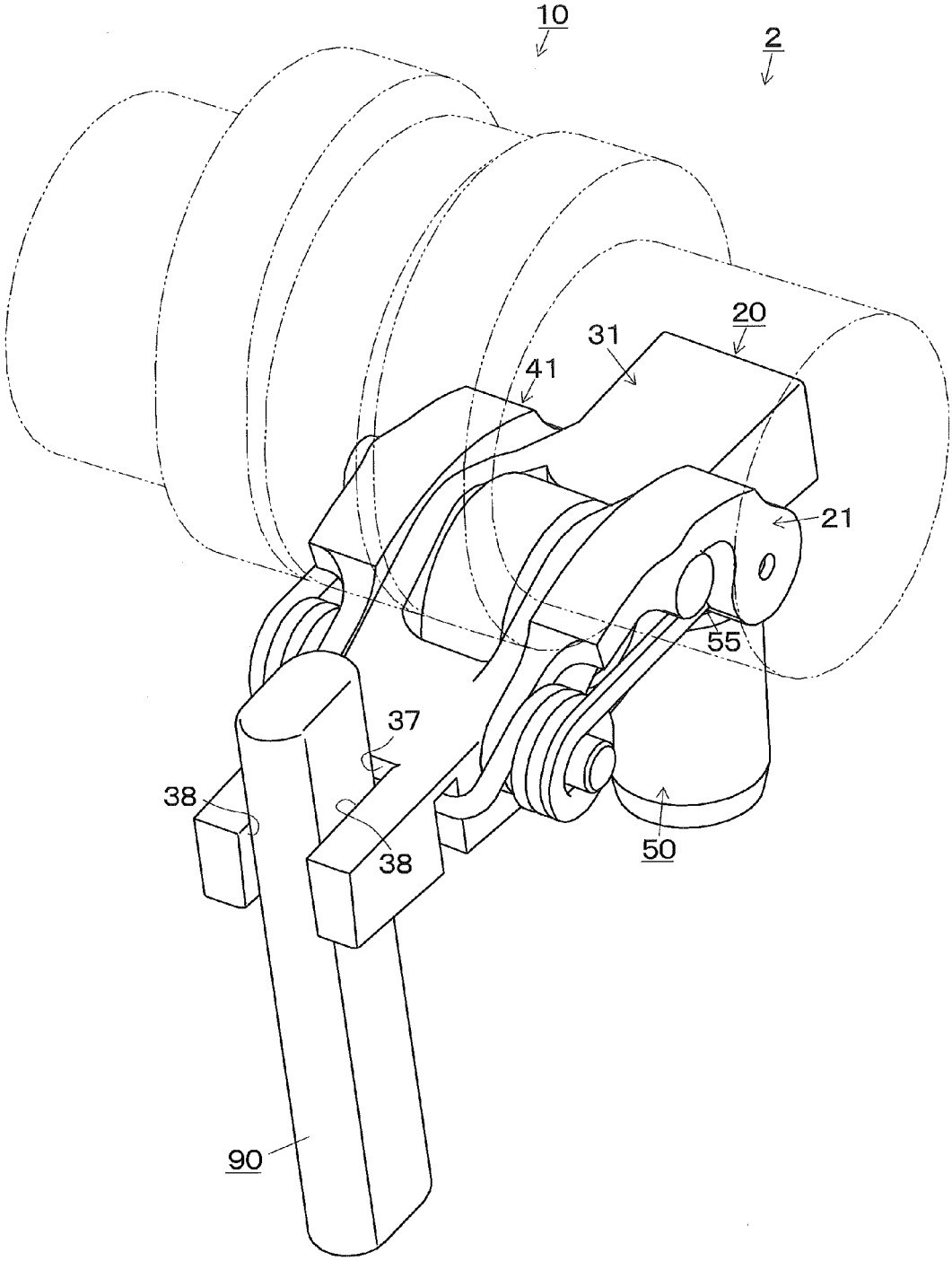
FIG. 6 is a perspective view illustrating a variable valve mechanism according to a second embodiment.

A variable valve mechanism 2 according to a second embodiment illustrated in FIG. 6 is different from the variable valve mechanism 1 according to the first embodiment in that the recessed portion 37 (guided portions 38) of the main arm 31 and the swing guide 90 are provided at the front end portion and on the front side, rather than at the rear end portion and on the rear side, of the main arm 31. The second embodiment is otherwise the same as the first embodiment. With the second embodiment as well, the effects [A] to [C] described in relation to the first embodiment can be obtained.

Third Embodiment

Figure 7A:
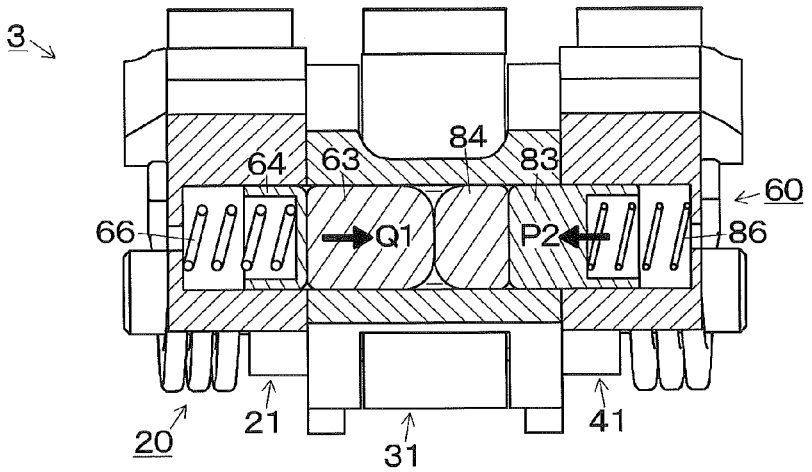
FIGS. 7A, 7B, and 7C are back sectional views illustrating a variable valve mechanism according to a third embodiment in a second coupled state, a non-coupled state, and a first coupled state, respectively.
Figure 7B:
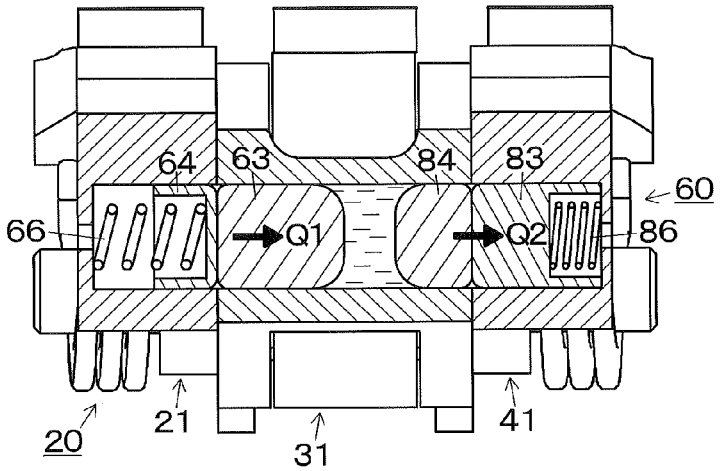
Figure 7C:
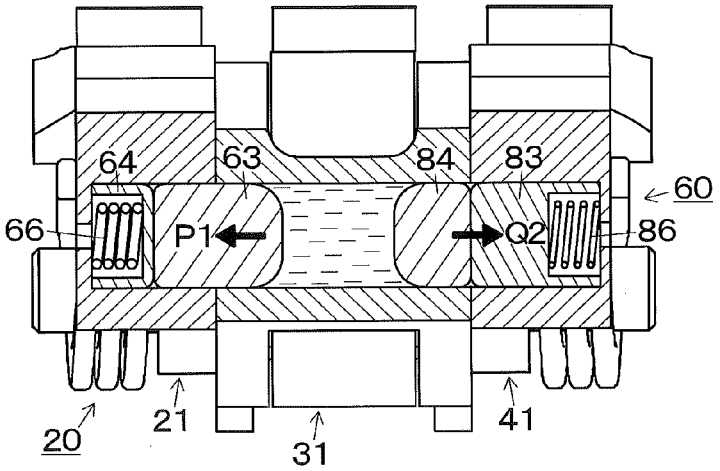
Figure 8:
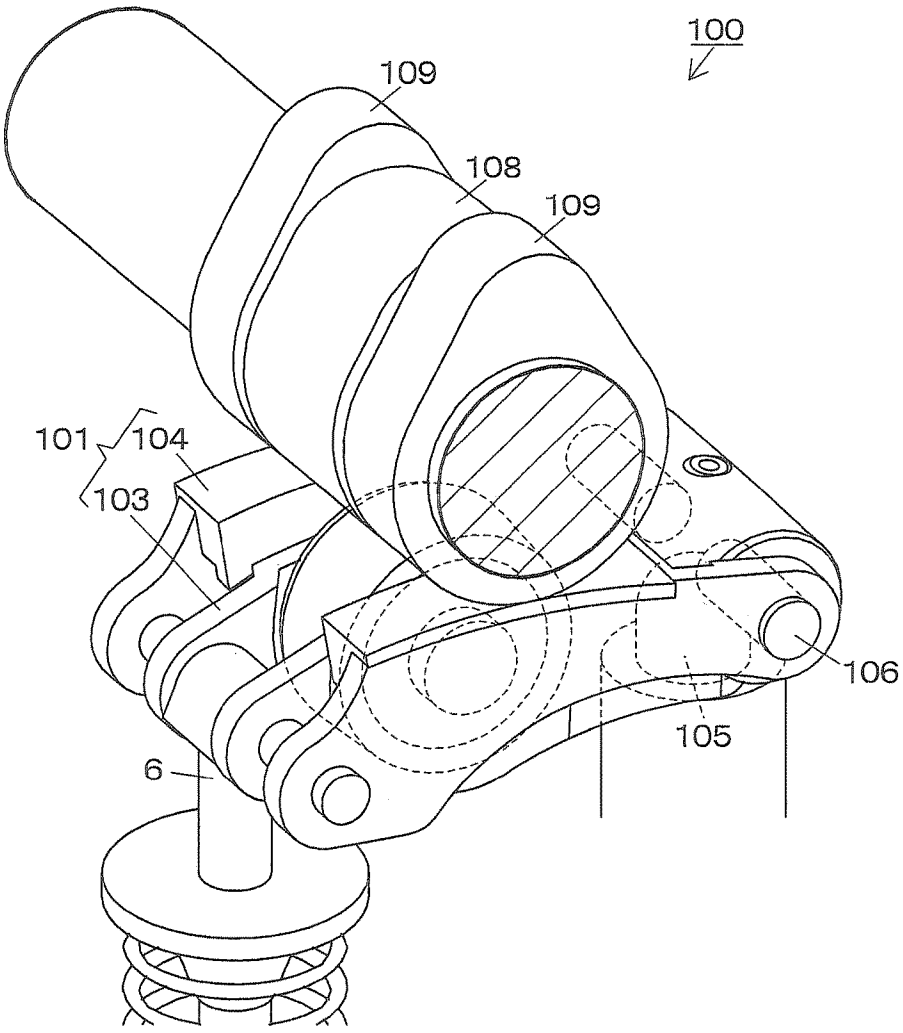
FIG. 8 PRIOR ART
FIG. 8 is a perspective view illustrating a variable valve mechanism according to the related art.
Figure 9:
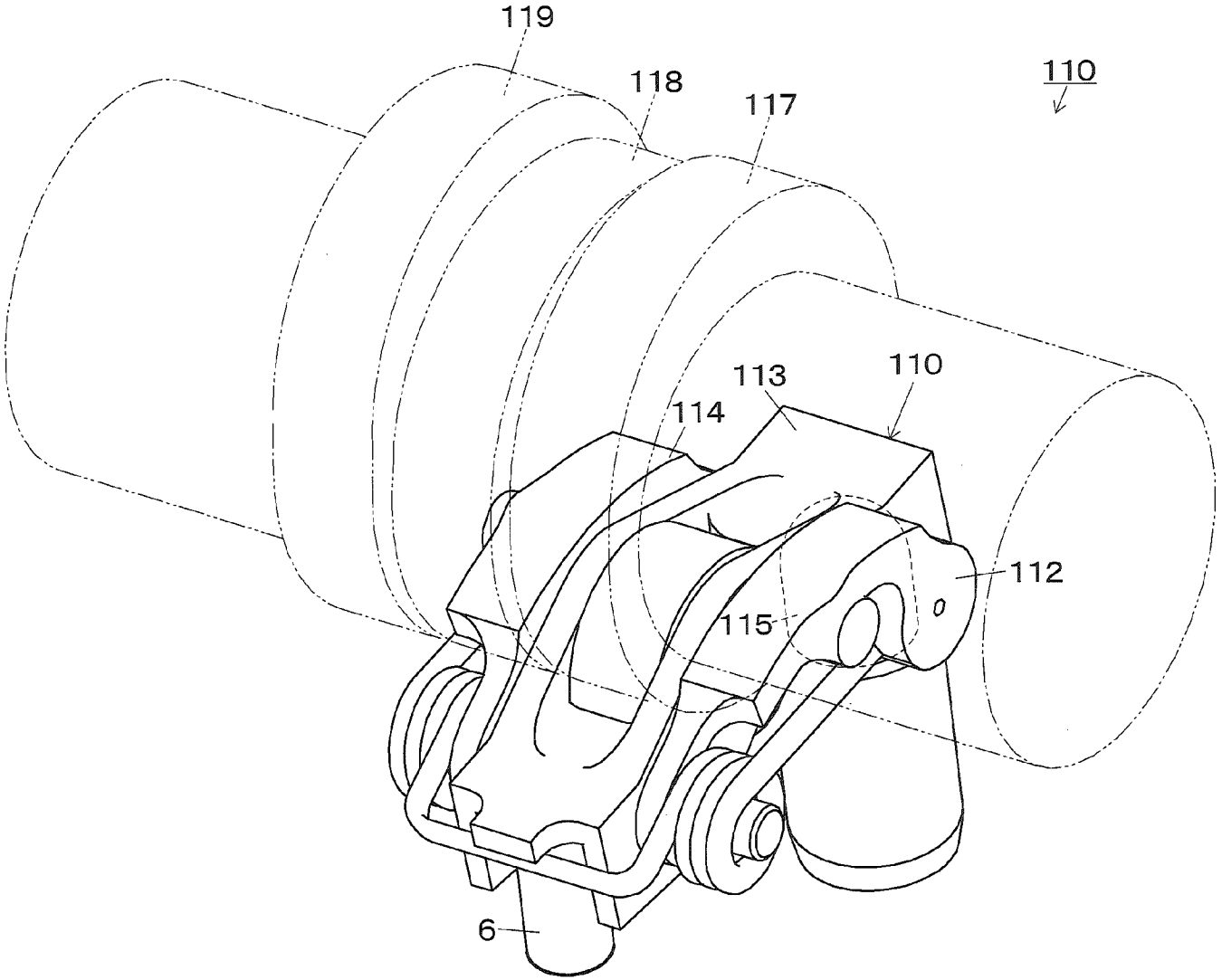
FIG. 9 is a perspective view illustrating a variable valve mechanism according to a reference example.

A variable valve mechanism 3 according to a third embodiment illustrated in FIGS. 7A to 7C is different, in terms of structure, from the variable valve mechanism 1 according to the first embodiment in that the urging force of the first spring 66 is stronger than the urging force of the second spring 86, that the second coupling position P2 and the second non-coupling position Q2 are opposite to each other, that is, the second coupling position P2 is on the main arm 31 side and the second non-coupling position Q2 is on the second sub arm 41 side, and that the second intervening pin 84 is located between the second coupling pin 83 and the first coupling pin 63, rather than between the second coupling pin 83 and the second spring 86. The third embodiment is otherwise the same as the first embodiment.

The variable valve mechanism 3 according to the third embodiment is different, in terms of function, in that the second coupled state is established by bringing the hydraulic pressure in the hydraulic chamber 74 to a low pressure as illustrated in FIG. 7A, that the non-coupled state is established by bringing the hydraulic pressure in the hydraulic chamber 74 to a medium pressure as illustrated in FIG. 7B, and that the first coupled state is established by bringing the hydraulic pressure in the hydraulic chamber 74 to a high pressure as illustrated in FIG. 7C. The third embodiment is otherwise the same as the first embodiment. With the third embodiment as well, the effects [A] to [C] described in relation to the first embodiment can be obtained.

The present invention is not limited to the configurations according to the first to third embodiments described above, and may be modified appropriately without departing from the scope and spirit of the present invention. For example, the small lift cam 13 may be changed to a circular cam including only the base circle 13*a* and not the small lift nose 13*b*.

REFERENCE SIGNS LIST

1 variable valve mechanism (first embodiment)
2 variable valve mechanism (second embodiment)

3 variable valve mechanism (third embodiment)
6 valve
12 medium lift cam (predetermined cam)
13 small lift cam
14 large lift cam (another cam)
20 rocker arm
21 first sub arm
25 first slipper (portion located away from the center line in the width direction)
31 main arm
41 second sub arm
45 second slipper (portion located away from the center line in the width direction)
55 plunger of lash adjuster (pivot)
60 switching device
63 first coupling pin
66 first spring
73 hydraulic device
74 hydraulic chamber
83 second coupling pin
86 second spring
x center line
P1 first coupling position (position at which the first coupling pin extends across an interface between the main arm and the first sub arm)
P2 second coupling position (position at which the second coupling pin extends across an interface between the main arm and the second sub arm)
Q1 first non-coupling position (position at which the first coupling pin does not extend across an interface between the main arm and the first sub arm)
Q2 second non-coupling position (position at which the second coupling pin does not extend across an interface between the main arm and the second sub arm)

The invention claimed is:

1. A variable valve mechanism of an internal combustion engine, the variable valve mechanism comprising:

a rocker arm that is swingably supported by a single pivot and that swings when pressed by a cam to drive a valve; and a switching mechanism that operates the rocker arm to switch a drive state of the valve, wherein, at least in a predetermined drive state, a pressing force of the cam is applied disproportionately to one side of the rocker arm in a width direction with respect to a center line when the cam presses a portion of the rocker arm located away from the center line in the width direction, the center line passing through a center of gravity of the rocker arm and extending in a longitudinal direction of the rocker arm; and a swing guide that abuts against the rocker arm so that the rocker arm is guided in a swing direction so as not to be tilted in the width direction, wherein the rocker arm includes a recessed portion provided at an end portion in the longitudinal direction of the rocker arm to be recessed inward in the longitudinal direction, and wherein the swing guide is in a sliding contact with an inner surface of the recessed portion from both sides in the width direction of the rocker arm to abut against the rocker arm.

2. The variable valve mechanism of the internal combustion engine according to claim 1, wherein the rocker arm includes three arms including a main arm, a first sub arm, and a second sub arm, the main arm including a supported portion supported by the single pivot and a drive portion that drives the valve, the first sub arm being pressed by a predetermined cam on one side in the width direction with respect to the center line, and the second sub arm being pressed by another cam with a lift amount or an action angle larger than that of the predetermined cam on an other side in the width direction with respect to the center line, wherein the switching mechanism performs a three-stage switching among a non-coupled state, a first coupled state, and a second coupled state, the non-coupled state being a state in which none of the first sub arm and the second sub arm is relatively indisplaceably coupled to the main arm, the first coupled state being a state in which the main arm is driven by the predetermined cam with the first sub arm relatively indisplaceably coupled to the main arm and with the second sub arm not relatively indisplaceably coupled to the main arm, and the second coupled state being a state in which the main arm is driven by the another cam with the second sub arm relatively indisplaceably coupled to the main arm; and wherein the pressing force of the cam is applied disproportionately to one side in the width direction with respect to the center line in the first coupled state, and the pressing force of the cam is applied disproportionately to the other side in the width direction with respect to the center line in the second coupled state.

3. The variable valve mechanism of the internal combustion engine according to claim 2, wherein the switching mechanism includes:

two coupling pins including a first coupling pin and a second coupling pin, the first coupling pin being provided so as to be displaceable between a position at which the first coupling pin extends across an interface between the main arm and the first sub arm and a position at which the first coupling pin does not, and the second coupling pin being provided so as to be displaceable between a position at which the second coupling pin extends across an interface between the main arm and the second sub arm and a position at which the second coupling pin does not;

two springs with different urging forces including a first spring and a second spring, the first spring urges the first coupling pin toward the main arm, and the second spring urges the second coupling pin toward the main arm; and a hydraulic device including a hydraulic chamber provided inside the main arm and pressing the first coupling pin toward the first sub arm and press the second coupling pin toward the second sub arm using a hydraulic pressure in the hydraulic chamber; and wherein one of three states is established by bringing the hydraulic pressure in the hydraulic chamber to a low pressure that is less than an urging force of the first spring or the second spring, whichever is weaker, another one of the three states is established by bringing the hydraulic pressure in the hydraulic chamber to a medium pressure that is more than the urging force of the first spring or the second spring, whichever is weaker and that is less than an urging force of the first spring or the second spring, whichever is stronger, and a remaining one of the three states is established by bringing the hydraulic pressure in the hydraulic chamber to a high pressure that is more than the urging force of the first spring or the second spring, whichever is stronger.

4. The variable valve mechanism of the internal combustion engine according to claim 1, wherein the rocker arm includes a supported portion supported by the single pivot, a drive portion that drives the valve, and a guided portion that abuts against the swing guide, the drive portion being provided on one side in the longitudinal direction of the rocker arm with respect to the supported portion, and the guided portion being provided on the other side in the longitudinal direction of the rocker arm with respect to the supported portion.

5. The variable valve mechanism of the internal combustion engine according to claim 1, wherein the rocker arm includes a supported portion supported by the single pivot, a drive portion that drives the valve, and a guided portion that abuts against the swing guide, the drive portion and the guided portion being provided on one side in the longitudinal direction of the rocker arm with respect to the supported portion.

6. The variable valve mechanism of the internal combustion engine according to claim 1, wherein the rocker arm includes a plurality of arms including a main arm, a first sub arm, and a second sub arm, the main arm including a supported portion supported by the single pivot and a drive portion that drives the valve, the first sub arm being pressed by a predetermined cam on one side in the width direction with respect to the center line, and the second sub arm being pressed by another cam with a lift amount or an action angle larger than that of the predetermined cam on an other side in the width direction with respect to the center line.

7. The variable valve mechanism of the internal combustion engine according to claim 6, wherein the switching mechanism performs a three-stage switching among a non-coupled state, a first coupled state, and a second coupled state, the non-coupled state being a state in which none of the first sub arm and the second sub arm is relatively indisplaceably coupled to the main arm, the first coupled state being a state in which the main arm is driven by the predetermined cam with the first sub arm relatively indisplaceably coupled to the main arm and with the second sub arm not relatively indisplaceably coupled to the main arm, and the second coupled state being a state in which the main arm is driven by the another cam with the second sub arm relatively indisplaceably coupled to the main arm.

8. The variable valve mechanism of the internal combustion engine according to claim 6, wherein the switching mechanism includes:

two coupling pins including a first coupling pin and a second coupling pin, the first coupling pin being provided so as to be displaceable between a position at which the first coupling pin extends across an interface between the main arm and the first sub arm and a position at which the first coupling pin does not, and the second coupling pin being provided so as to be displaceable between a position at which the second coupling pin extends across an interface between the main arm and the second sub arm and a position at which the second coupling pin does not.

9. The variable valve mechanism of the internal combustion engine according to claim 8, wherein the switching mechanism further includes:

two springs with different urging forces including a first spring and a second spring, the first spring urges the first coupling pin toward the main arm, and the second spring urges the second coupling pin toward the main arm.

10. The variable valve mechanism of the internal combustion engine according to claim 9, wherein the switching mechanism further includes:

a hydraulic device including a hydraulic chamber provided inside the main arm and pressing the first coupling pin toward the first sub and press the second coupling pin toward the second sub arm using a hydraulic pressure in the hydraulic chamber.

11. The variable valve mechanism of the internal combustion engine according to claim 10, wherein one of three states is established by bringing the hydraulic pressure in the hydraulic chamber to a low pressure that is less than an urging force of the first spring or the second spring, whichever is weaker, another one of the three states is established by bringing the hydraulic pressure in the hydraulic chamber to a medium pressure that is more than the urging force of the first spring or the second spring, whichever is weaker and that is less than an urging force of the first spring or the second spring, whichever is stronger, and a remaining one of the three states is established by bringing the hydraulic pressure in the hydraulic chamber to a high pressure that is more than the urging force of the first spring or the second spring, whichever is stronger.

12. A variable valve mechanism of an internal combustion engine, the variable valve mechanism comprising:

a rocker arm that is swingably supported by a single pivot and that swings when pressed by a cam to drive a valve; and a switching mechanism that operates the rocker arm to switch a drive state of the valve, wherein, at least in a predetermined drive state, a pressing force of the cam is applied disproportionately to one side of the rocker arm in a width direction with respect to a center line when the cam presses a portion of the rocker min located away from the center line in the width direction, the center line passing through a center of gravity of the rocker arm and extending in a longitudinal direction of the rocker arm; and a swing guide that abuts against the rocker arm so that the rocker arm is guided in a swing direction so as not to be tilted in the width direction, wherein the rocker arm includes a recessed portion provided at an end portion in the longitudinal direction of the rocker arm to be recessed inward in the longitudinal direction.

13. The variable valve mechanism of the internal combustion engine according to claim 12, wherein the swing guide is in a contact with an inner surface of the recessed portion from both sides in the width direction of the rocker arm.

14. The variable valve mechanism of the internal combustion engine according to claim 12, wherein the rocker arm includes a plurality of arms including a main arm, a first sub arm, and a second sub arm, the main arm including a supported portion supported by the single pivot and a drive portion that drives the valve, the first sub arm being pressed by a predetermined cam on one side in the width direction with respect to the center line, and the second sub arm being pressed by another cam with a lift amount or an action angle larger than that of the predetermined cam on an other side in the width direction with respect to the center line.

15. The variable valve mechanism of the internal combustion engine according to claim 14, wherein the switching mechanism performs a three-stage switching among a non-coupled state, a first coupled state, and a second coupled state, the non-coupled state being a state in which none of the first sub arm and the second sub arm is relatively indisplaceably coupled to the main arm, the first coupled state being a state in which the main arm is driven by the predetermined cam with the first sub relatively indisplaceably coupled to the main arm and with the second sub arm not relatively indisplaceably coupled to the main arm, and the second coupled state being a state in which the main arm is driven by the another cam with the second sub arm relatively indisplaceably coupled to the main arm.

16. The variable valve mechanism of the internal combustion engine according to claim 14, wherein the switching mechanism includes:

two coupling pins including a first coupling pin and a second coupling pin, the first coupling pin being provided so as to be displaceable between a position at which the first coupling pin extends across an interface between the main arm and the first sub arm and a position at which the first coupling pin does not, and the second coupling pin being provided so as to be displaceable between a position at which the second coupling pin extends across an interface between the main arm and the second sub arm and a position at which the second coupling pin does not.

17. The variable valve mechanism of the internal combustion engine according to claim 16, wherein the switching mechanism further includes:

two springs with different urging forces including a first spring and a second spring, the first spring urges the first coupling pin toward the main arm, and the second spring urges the second coupling pin toward the main arm.

18. The variable valve mechanism of the internal combustion engine according to claim 17, wherein the switching mechanism further includes:

a hydraulic device including a hydraulic chamber provided inside the main arm and pressing the first coupling pin toward the first sub arm and press the second coupling pin toward the second sub arm using a hydraulic pressure in the hydraulic chamber.

19. The variable valve mechanism of the internal combustion engine according to claim 18, wherein one of three states is established by bringing the hydraulic pressure in the hydraulic chamber to a low pressure that is less than an urging force of the first spring or the second spring, whichever is weaker, another one of the three states is established by bringing the hydraulic pressure in the hydraulic chamber to a medium pressure that is more than the urging force of the first spring or the second spring, whichever is weaker and that is less than an urging force of the first spring or the second spring, whichever is stronger, and a remaining one of the three states is established by bringing the hydraulic pressure in the hydraulic chamber to a high pressure that is more than the urging force of the first spring or the second spring, whichever is stronger.

* * * * *